United States Patent [19]

Rodriquez

[11] Patent Number: 4,598,918

[45] Date of Patent: Jul. 8, 1986

[54] ROLLER DISC ASSEMBLY AND SKATE

[76] Inventor: Jose A. Rodriquez, 2921 Briggs Ave., Bronx, N.Y. 10457

[21] Appl. No.: 720,350

[22] Filed: Apr. 5, 1985

[51] Int. Cl.[4] ..... A63C 17/08

[52] U.S. Cl. ..... 280/11.24; 16/46; 280/11.1 BR; 301/5.7

[58] Field of Search ..... 280/11.24, 11.25, 11.19, 280/11.1 R, 11.1 BR; 180/7.1; 193/35 MD, 37, 35 C; 16/21, 26, 46; 301/5.7

[56] References Cited

U.S. PATENT DOCUMENTS

| | | | |
|---|---|---|---|
| 1,616,442 | 2/1927 | DeFestenburg et al. | 280/11.1 BR |
| 1,617,984 | 2/1927 | Biggio | 301/5.7 |
| 1,975,661 | 10/1934 | Powell | 280/80 R |
| 3,885,804 | 5/1975 | Cudmore | 280/11.2 |
| 3,963,251 | 6/1976 | Miano | 280/11.1 BR |
| 4,034,995 | 7/1977 | Forward et al. | 280/11.23 |
| 4,149,735 | 4/1979 | Blackburn et al. | 280/11.1 BR |

FOREIGN PATENT DOCUMENTS

| | | | |
|---|---|---|---|
| 494395 | 1/1929 | Fed. Rep. of Germany | 280/11.1 BR |
| 11407 | 1/1980 | Japan | 193/35 MD |

*Primary Examiner*—David M. Mitchell
*Assistant Examiner*—Eric D. Culbreth
*Attorney, Agent, or Firm*—Milton L. Honig

[57] ABSTRACT

A roller disc assembly is provided comprising a stationary disc platform beneath which is rotatably mounted a disc wheel, said wheel having at least partially a flat bottom surface. A ball bearing ring is sandwiched between said disc platform and wheel, the combination held together by a bolt fitted through a tubular channel bored perpendicular to the roller disc assembly. Furthermore, a skate is provided comprising a foot supporting member and the roller disc assembly. In a preferred embodiment, the skate is additionally fitted with a ball bearing caster mounted beneath the toe area of the foot supporting member.

14 Claims, 6 Drawing Figures

ROLLER DISC ASSEMBLY AND SKATE

BACKGROUND OF THE INVENTION

1. Field of the Invention

The roller disc assembly of the present invention is intended for mounting on the underside of a platform, such as a shoe, to enable the platform to move either in forward/backward, circumferential, lateral or stationary rotational directions.

2. The Prior Art

In the roller skate art, a variety of locomotion mechanisms have been proposed. For instance, U.S. Pat. No. 1,975,661 discloses a pair of large-diametered disc-like wheels attached to a skate platform. Each wheel is set at an angle of less than 45 degrees with the surface on which it is intended to roll. Wheel movement permits the skate or other platform to travel in a linear forward or backward direction.

U.S. Pat. No. 3,885,804 describes a skate comprising a sole plate, boot and two large, canted, equal-sized wheels mounted upon axles extending outwardly from the sole plate. Undue strain and discomfort to the skater's ankles were said to be eliminated by placement of the wheel tire below the center line of the sole plate and by positioning plate close to the ground. Unfortunately, this wheel assembly has neither lateral nor circumferential nor stationary rotational movement.

In U.S. Pat. No. 4,149,735 is disclosed a skateboard with a pivot roller. A skateboard rider is thereby enabled to perform 360 degree rotations by shifting weight which tilts the board and engages a pivot roller. Lateral or circumferential movements are, however, not achievable therewith.

Ball bearings have been used as the prime support and locomotion means for the skates described in U.S. Pat. No. 1,616,442, U.S. Pat. No. 3,963,251 and U.S. Pat. No. 4,034,995. Primary support through ball bearings is undesirable. Discomfort arises because highly concentrated loads are placed on both the ball structure and on the supporting surface. Furthermore, skating is rendered inefficient because ball bearings provide no transverse reactive forces which normally permit skaters to propel themselves faster.

Consequently, it is an object of this invention to provide a roller disc assembly, that when in skate form, is foot comfortable and is capable of linear forward/backward, circumferential, lateral and stationary rotational movement.

Another object of this invention is to provide a skate with a roller disc assembly having the aforementioned freedoms of movement.

A final object of this invention is to provide a skate with a roller disc assembly additionally capable of toe pivot movement.

SUMMARY OF THE INVENTION

A roller disc assembly is provided comprising a stationary disc platform beneath which is rotatably mounted a disc wheel, said wheel having at least partially a flat bottom surface, said surface being the primary support when disc wheel is in resting contact with the ground. The outer circumferential edge of the disc wheel bottom surface is preferentially either rounded or straight-angled. The disc wheel is capable of 360 degree rotation relative to the disc platform. When caused to tilt at an angle of less than 45 degrees from a floor surface, the wheel assembly is capable of lateral or forward/backward movement depending upon which point along the circumferential outer edge of the tilt force is applied.

Furthermore, a skate is provided which includes a foot supporting member whereunder is attached a wheel assembly according to theaforementioned description. In a preferred embodiment of the skate, a ball bearing caster is attached to the foot supporting member in addition to the wheel assembly. Most preferably, the wheel assembly is affixed centrally and ball bearing caster affixed to the toe area, each under the foot supporting member.

BRIEF DESCRIPTION OF THE DRAWINGS

A more complete understanding of the present invention may be had from the following detailed description, particularly when read in light of the accompanying drawings wherein.

DESCRIPTION OF THE PREFERRED EMBODIMENT

Figure 1:
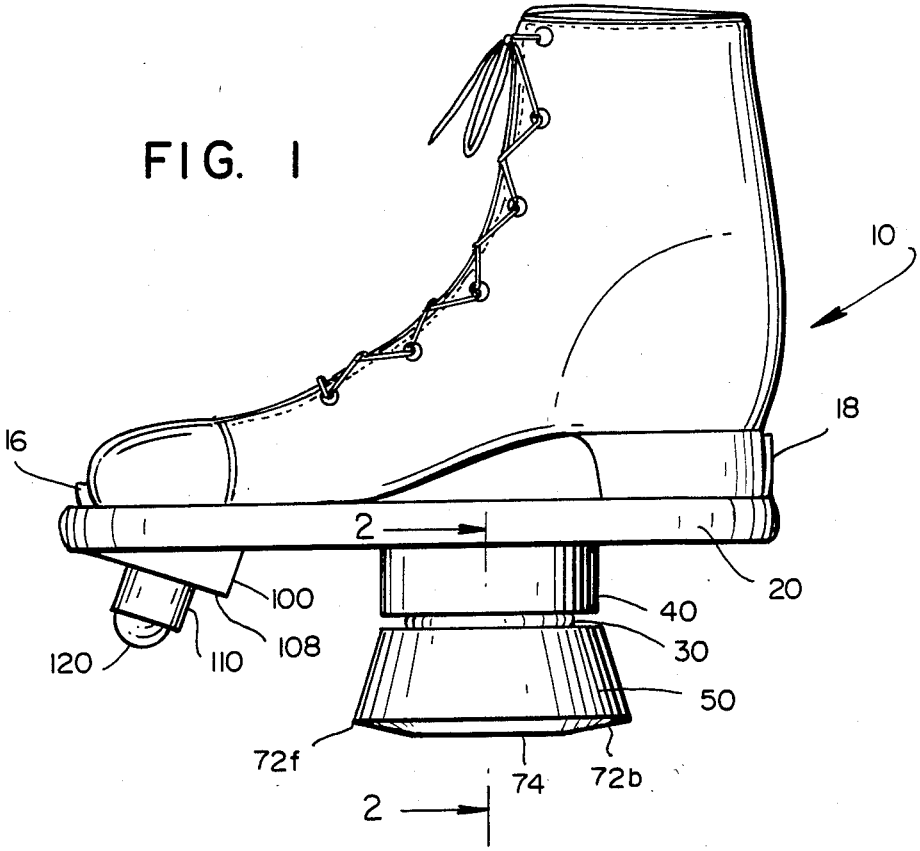
FIG. 1 is a side elevational view of the roller disc skate.

In the drawings FIG. 1 represents the left roller disc skate which is a mirror image of the right skate. For that reason, only the shown left skate is described in this application.

The skate has a sole plate 20 which is substantially horizontal. At approximately midway along the bottom of the sole plate 20 is rigidly attached a round disc platform 40. The disc platform 40 rotatably communicates through ball bearing ring 30 with disc wheel 50. The bottom face of disc wheel 50 features a central circular flattened area 74. Hollow recess 80 is situated at the center of area 74. Recess 80 houses nut 84 which secures bolt 60. The plane of circumferential outer edge 72 is tilted slightly at an angle from the horizontal plane of area 74.

Beneath the toe area of skate 10 is situated a support wedge 100 rigidly attached to the sole plate 20. A caster housing 110 is mounted on the lower surface 108 of the wedge 100. Ball bearing 120 is rotatably held within, and partially protrudes from said caster housing 110. Suitable casters are commercially available from the Acme Caster Company, Poughkeepsie, N.Y., sold under the mark Acme Ball Bearing Caster #656A-1¼. Particularly preferred are casters described in U.S. Pat. No. 1,616,442, herein incorporated by reference.

A skater, wearing the roller disc skate, may propel himself in a forward or backward direction by shifting upon the in-step of each foot and balancing on the circumferential edge 72 while pushing with one foot to begin motion. Alternatively, balancing upon the knife blade or outer edge of each foot using edge 72 accomplishes a similar motion. In both exercises the ball bearing 120 is kept raised from contact with the floor.

Lateral movement is achieved by balancing forward on the toe to engage ball bearing 120 with the floor.

Concommittantly, forward edge 72*f* of the disc wheel 50 is caused to contact the floor. A push from the other foot results in ball bearing 120 and edge 72*f* combining to effect a lateral movement.

Spin motion may be achieved by balancing upon the aforementioned combination of bearing 120 and edge 72*f*. The best spinning, however, arises from stationary pivoting upon flat surface 74. The skater rotates his foot and therewith the attached disc platform 40, over the circular path of ball bearing ring 30.

Another type of forward movement achievable with the roller disc mechanism is one where the skater advances at an angle from the shoe direction. The movement arises by balancing with the toes sideways upon edge 72 of the roller disc wheel and upon ball bearing 120 of both skates. As each leg alternates, an angular movement occurs. A similar backward movement at an angle may be achieved by balancing on the heel area of roller wheel 50 using edge 72 and alternating each leg.

Figure 2:
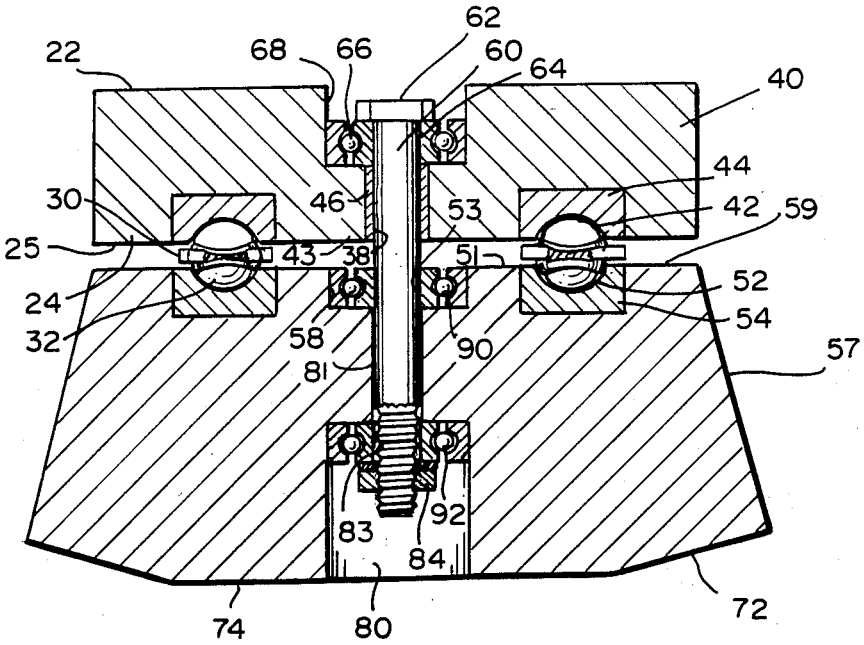
FIG. 2 is a cross-sectional view of the roller disc assembly taken along line 2—2 of FIG. 1.

FIG. 2 is a cross-sectional view slicing through and exposing the roller disc mechanism. The upper surface 22 of said disc platform 40 exhibits a tap hole 68. Within tap hole 68 is situated ball bearing ring 66 whose inner cylinder 64 is freely rotatable. Spacer pipe 46 is rigidly fastened into disc platform 40 and placed in alignment with inner cylinder 64, the combination forming a channel through which bolt 60 is inserted. Spacer pipe 46 prevents wobble of bolt between the bearing rings. Bolt head 62 rests against the top of the ball bearing ring 66. When lock nut 84 is tightened, bolt 60 is enabled to freely rotate within its channel by virtue of tight communication by head 62 and bolt body 60 with ball bearing inner cylinder 64. The bolt/cylinder arrangement not only provides free movement for the bolt/lock nut, but also prevents loosening of the lock nut when in motion.

Bottom face 25 of the disc platform 40 contains at its center an exit 38 corresponding to pipe segment 46. A circumferential metal ring 44 is fixedly placed within face 25. A groove 42 is circumferentially cut into ring 44. Ball 32 of case bearing 30 fits within groove 42 and can travel freely in its circumferential path.

A mirror image of ring 44 having groove 42, i.e. ring 54 having groove 52, is fixedly emplaced within face 59 of drsc wheel 50. A ball bearing ring 90, identical to ring 66, is held within tap hole 58. Inner cylinder 53 of ball bearing ring 90 is freely rotatable. Channel 81 is aligned with and connects cylinder 53 with cylinder 83 of ball bearing ring 92. Tap hole 80 is present to retain said ring 92 and lock nut 84.

Figure 3:
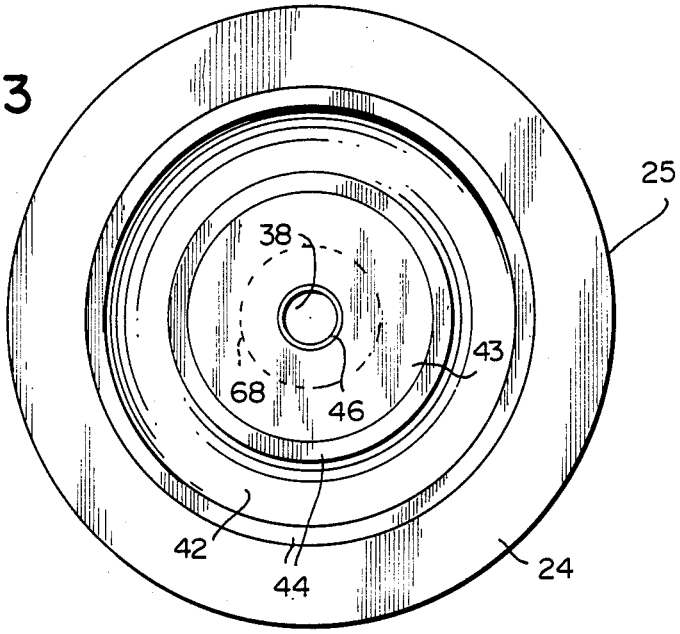
FIG. 3 is a bottom face view of the disc platform shown in FIG. 1.
Figure 4:
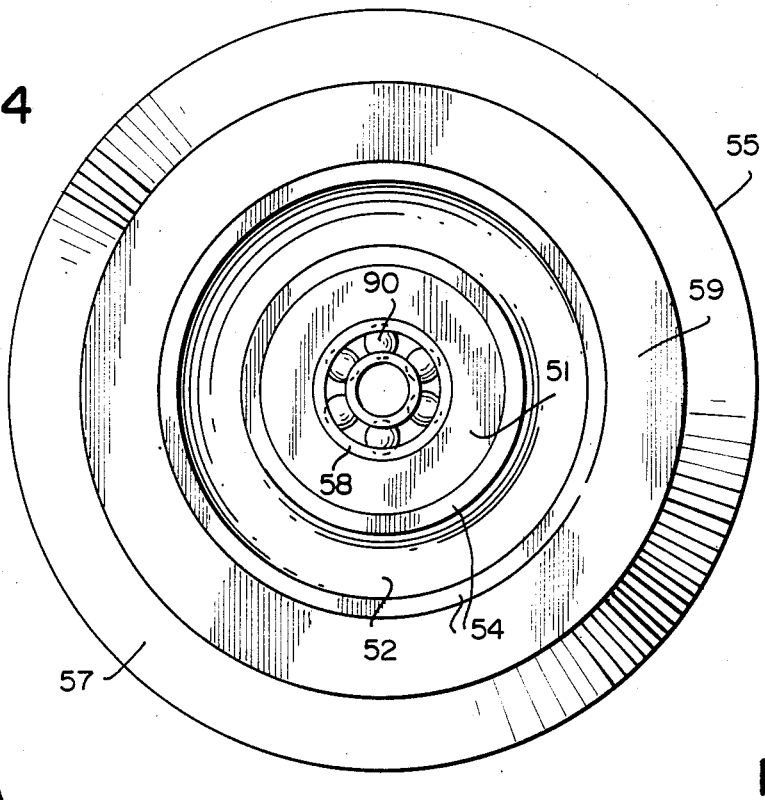
FIG. 4 is a top face view of the disc wheel shown in FIG. 1.

FIG. 3 illustrates in detail the bottom face of disc platform 40. FIG. 4 displays a top face view of disc wheel 50, said top face communicating through ball bearing ring 30 with the bottom face of the disc platform 40.

Ball bearing rings 66 and 92 serve as retainers for bolt head 62 and nut 84 and permit securing together of the disc platform with the disc wheel. Furthermore, these rings prevent nut 84 from loosening when the wheel assembly is in motion. Without these ball bearing rings, nut 84 would, through use, unthread from bolt 60. Bearing ring 90 surrounds bolt 60 at about midpoint to prevent wobbling of the bolt 60. Thereby, wear of channel 81 is also prevented.

Figure 5A:
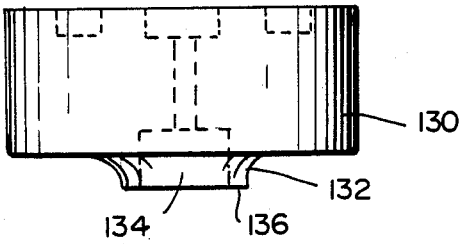
FIG. 5A and FIG. 5B are side cross-sectional views, in partial relief, of two alternate disc wheel embodiments which may be utilized in the present invention.
Figure 5B:
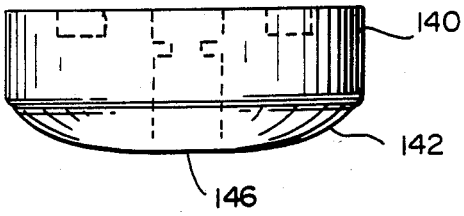

Another important aspect of this invention is the need for the disc wheel to possess, at least in part, a central circular flat bottom surface. FIGS. 5A and 5B provide two alternative disc wheels, 130 and 140 respectively. Wheel 130 has attached on its lower surface a circular stage member 132 having a hollow inner cavity 134 partially extending into the disc wheel body. The circumferential surface 136 of member 132 must be wide enough to support skating action. Wheel 140 is similar to wheel 50 except for the presence of a highly rounded edge 142. Central to the lower surface of wheel 140 is a flattened area 146.

Various modifications and changes may be made with regard to the foregoing detailed description without departing from the spirit and scope of this invention.

What is claimed is:

1. A roller disc assembly comprising:

a stationary disc platform having a tap hole having an axis;

a ball bearing ring lying horizontally within said hole in a plane perpendicular to said axis;

a cylinder defining the inward wall of said ball bearing ring, said cylinder being freely rotatable and forming part of a tubular channel perpendicularly penetrating through the width of said disc platform along said axis;

a disc wheel;

a central flat circular surface forming the lower face of said disc wheel;

a tubular channel formed by an aperture directed perpendicular to said surface and penetrating the full width of the disc wheel;

a ball bearing ring lying horizontally within said aperture, said disc platform and disc wheel channels being aligned and of essentially equal diameter;

a ball bearing ring communicating with a bottom surface of said disc platform and a top surface of said disc wheel; and a connecting member passing through both of said disc platform and disc wheel tubular channels to fastenably hold together said disc platform and disc wheel.

2. A roller disc assembly according to claim 1 further comprising a ball bearing ring within a tap hole, said hole penetrating said top surface of the disc wheel, said ring being aligned with said other ball bearing rings of said disc platform and disc wheel.

3. A roller disc assembly according to claim 1 wherein said disc wheel has a straight angled circumferential outer edge surrounding said central flat circular surface.

4. A roller disc assembly according to claim 1 wherein said disc wheel has a rounded circumferential outer edge surrounding said central flat circular surface.

5. A roller disc assembly according to claim 1 wherein said disc wheel is capable of 360 degree rotation relative to said disc platform.

6. A skate comprising:

a foot supporting member having a bottom surface;

a stationary disc platform having an upper surface rigidly attached to the bottom surface of said foot supporting member, said platform having a tap hole;

a ball bearing ring lying horizontally within said hole;

a cylinder defining the inward wall of said ball bearing ring, said cylinder being freely rotatable and forming part of a tubular channel perpendicularly penetrating through the width of said disc platform;

a disc wheel;

a central flat circular surface forming the lower face of said disc wheel;

a tubular channel formed by an aperture directed perpendicular to said surface and penetrating the full width of the disc wheel;

a ball bearing ring lying horizontally within said aperture, said disc platform and disc wheel channels being aligned and of essentially equal diameter;

a ball bearing ring communicating with a bottom surface of said disc platform and a top surface of said disc wheel; and a connecting member passing through both of said disc platform and disc wheel tubular channels to fastenably hold together said disc platform and disc wheel.

7. A skate according to claim 6 wherein the skate further comprises a ball bearing ring within a tap hole, said hole penetrating said top surface of the disc wheel, said ring being aligned with said other ball bearing rings of the disc platform and disc wheel.

8. A skate according to claim 6 wherein said disc wheel has a straight angled circumferential outer edge surrounding said central flat circular surface.

9. A skate according to claim 6 wherein said disc wheel has a rounded circumferential outer edge surrounding said central flat circular surface.

10. A skate according to claim 6 wherein said disc wheel is capable of 360 degree rotation relative to said disc platform.

11. A skate according to claim 6 wherein said roller disc assembly is centrally located beneath the foot supporting member.

12. A skate according to claim 6 further comprising a ball bearing caster attached underneath the foot supporting member.

13. A skate according to claim 12 wherein said caster is attached beneath toe area of said foot supporting member and the roller disc assembly is centrally located beneath said foot supporting member.

14. A skate according to claim 13 wherein when said disc wheel rests upon the ground by contact through the lower face central flat circular surface, said caster is insufficiently long to contact said ground.

* * * * *